United States Patent [19]

Gueussier et al.

[11] Patent Number: 4,531,972

[45] Date of Patent: Jul. 30, 1985

[54] METHOD FOR THE FABRICATION OF STEELS WITH HIGH MACHINABILITY

[75] Inventors: André Gueussier, Paris; Edmond Vachiery, Solesmes, both of France

[73] Assignee: Vallourec, Adenauer, France

[21] Appl. No.: 548,212

[22] Filed: Nov. 2, 1983

[30] Foreign Application Priority Data

Mar. 15, 1983 [FR] France ..... 83 04611

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,467,167 | 9/1969 | Mahin | 75/58 |
| 3,575,695 | 4/1971 | Miyashita | 75/58 |
| 3,649,253 | 3/1971 | Kaess | 75/58 |
| 4,057,420 | 11/1977 | Brace | 75/53 |
| 4,094,666 | 6/1978 | Ototani | 75/53 |
| 4,286,984 | 9/1981 | Luyckx | 75/58 |

*Primary Examiner*—Peter D. Rosenberg

*Attorney, Agent, or Firm*—McDougall, Hersh & Scott

[57] ABSTRACT

The invention relates to the methods for the preparation of steels with high machinability, comprising globular inclusions which allow for high cutting speeds by means of carbide tools.

The method according to the invention consists of introducing into a liquid steel which has been deoxidized carefully with aluminum, and desulfurized, additions of calcium and sulfur, carried out by a cored wire, the contents obtained being from 20 to 100 ppm calcium and 150 to 500 ppm sulfur.

The steels prepared under this method offer a particular aptitude for high speed machining with the aid of carbide cutting tools.

12 Claims, No Drawings

METHOD FOR THE FABRICATION OF STEELS WITH HIGH MACHINABILITY

The method which is the subject matter of the invention relates to steels with high machinability.

It is a well known fact that the machinability of steels depends primarily on the nature and the morphology of the inclusions present in the metal. These are essentially oxides and sulfides. The oxides have an unfavorable action on the cutting tool; on the other hand, the sulfides may play a favorable part of a lubricant.

In the case of machining at moderate cutting speed with the aid of high speed cutting tools, the sulfides play an essential part and steels are used the sulfur content of which may vary from 0.07 to 0.33%.

In the case of machining at high cutting speed with the aid of carbide tools, the high sulfur contents have no particularly favorable effect. On the contrary, it has been noted that the oxide inclusions are particularly harmful, as they cause wear of the cutting tool. It is possible to reduce the harmful effect of these inclusions by known means. To be specific, their quantity may be reduced by a good deoxidation and a good decantation.

These globular inclusions, generally on an alumina base, also may be reduced by the addition of earth-alkaline elements, such as calcium or of other elements. Finally, arrangements may be made so that these remaining globular inclusions contain a certain quantity of combined sulfur which reduces their harmfulness. In this case, the sulfur content generally is not higher than the one which usually is present in the steel, that is to say lower than 500 ppm (parts per million in mass), and generally on the order of 150 to 500 ppm. In this range it is sought generally to aim at a more narrow sulfur content range, but this presents serious difficulties.

Generally, experience has shown that it is difficult to prepare steels which are low in inclusions in a reproducible manner. These inclusions are rendered less harmful by their globular shape and by the presence of combined sulfur.

These difficulties are due particularly to the fact that it is difficult to properly control the sulfur contents of the steels after deoxidation, just as it is not any easier to control with accuracy the possible additions of sulfur effected in the steel, and finally that the output of the additions of calcium making it possible to give up the globular inclusions lacks reproducibility.

The possibility has been contemplated to design a method for the preparation of steels with a high machinability which are particularly appropriate for high speed machining by means of carbide cutting tools, by the addition of sulfur and calcium, under conditions making it possible to obtain a high efficiency of the combined action of calcium and sulfur, as well as an excellent reproducibility of the results, while controlling the sulfur content within narrow ranges of composition; said content should not exceed the upper limit of sulfur content currently admitted in the steels which contain no voluntary addition of sulfur.

The possibility has been sought particularly for developing a method of introducing calcium and sulfur into the liquid steel, which makes it possible to adjust with great accuracy the quantities of calcium introduced into the steel in metallic form, as well as the corresponding quantities of sulfur, in order to obtain optimal results from a machining point of view, in a reproducible manner.

The method which is the subject matter of the invention offers a particularly advantageous solution to the problem being faced.

It consists of preparing in a conventional manner, a non-alloyed or alloyed, or stainless steel, then to effect an addition of aluminum in order to reduce the oxygen content of the steel to less than 100 ppm, to effect then or simultaneously a desulfurization pushed by a basic slag in order to reduce the sulfur content of the steel to less than 100 ppm, then to effect, by means of a cored wire, additions of calcium and sulfur in order to attain in the steel a calcium content of 20 to 100 ppm and a sulfur content of 150 to 500 ppm. The treatment is carried out advantageously with aluminum, in order to obtain a residual aluminum content dissolved in the steel, ranging between 150 and 500 ppm. The oxygen content preferably is reduced to less than 50 ppm and preferably also, the desulfurization is carried out until a sulfur content of less than 50 ppm is obtained. The calcium and sulfur additions may be carried out either successively, with the calcium being introduced first, or simultaneously.

The addition of calcium is effected by means of a cored wire advantageously containing a calcium alloy in granular or powder form, such as a silico-calcium.

The addition of sulfur is carried out with the aid of a cored wire advantageously containing flowers of sulfur or a sulfide.

In the case of simultaneous addition of calcium and sulfur, it is possible to use several cored wires or only one cored wire containing both calcium and sulfur in the desired proportions.

The method makes it possible to obtain in a reproducible manner, steels for which the spread between the sulfur content obtained and the intended content does not exceed ±40 ppm.

Thanks to the very accurate additions of calcium and sulfur thus effected, the method according to the invention makes it possible to obtain finely distributed globular inclusions which confer in a reproducible manner a high rate of machinability upon the steel. These steels are particularly suitable for high speed machining with the aid of carbide cutting tools.

In a detailed manner, the method according to the invention can be embodied advantageously in the following manner:

A steel such as an alloyed or non-alloyed steel of the standard type is prepared in a conventional manner;

At the end of the preparation this steel is deoxidized by means of aluminum, the quantity of which is determined to obtain a residual content of aluminum dissolved in the steel of about 150 to 500 ppm, this intended residual content being the stronger the lower, within these limits, the carbon content is going to be. Then the desulfurization is carried out, for example, by means of a basic slag which may be constituted for example by lime or by an aluminum-calcium composition. To allow for a very strong desulfurization, the liquid metal must be mixed in contact with the slag, for example by blowing a neutral gas across this metal or by any other means. The final sulfur and oxygen contents must, preferably, be below 50 ppm for each of these elements.

Subsequently the calcium is introduced into the liquid steel by means of a cored wire, like for example the one which is described in the French Patent No. 2,476,542. This wire is constituted by a jacket, generally of mild steel, with a thickness of several tenths of a millimeter, which surrounds the core containing the calcium in finely divided condition in metal or alloy form. The cored wire preferably is introduced at a relatively high speed, generally on the order of 1 to several meters per second. This speed is adjusted in function of the calcium content of the cored wire per unit of length and of the quantity to be introduced, so that the duration of this introduction does not exceed several minutes. The wire is caused to penetrate the metal bath from top to bottom, at an angle preferably close to 90° in relation to the horizontal line. Thus it is possible to cause the calcium to penetrate the liquid steel very profoundly, which considerably increases the effectiveness of the addition. The quantity of calcium thusly introduced into the liquid bath, in metal or alloy form, preferably ranges between 150 and 600 grams/ton, which makes it possible, after the reduction of the oxides still present in this metal, to obtain a calcium content preferably ranging between 20 and 80 ppm. The liquid steel bath to which calcium thus has been added is homogenized, preferably by agitation, prior to the addition of sulfur. This latter addition is carried out with the aid of a cored wire containing either flowers of sulfur or a sulfide, such as iron or manganese sulfide, in pulverulent or granular form. Generally the jacket is of mild steel with a thickness of several tenths of a millimeter, like in the case of the addition of calcium. The sulfur is introduced like the calcium, at a relatively high speed.

It is attempted to obtain in the liquid steel a sulfur content ranging between 150 and 500 ppm. The yield of introduction generally is higher than 90% thanks to the use of cored wire, which makes it possible to adjust the addition of sulfur with a high degree of accuracy.

In the art, by effecting additions of flowers of sulfur, it is possible to admit a yield on the order of 95%.

Following the introduction of the sulfur, the steel is cast either in ingots or by means of a continued casting installation. Maximum precautions must be taken to avoid reoxidation of the liquid steel jets during this casting operation.

The following examples describe two manners of preparation of a steel with a high degree of machinability in a non-limitative manner, by way of the method according to the invention:

EXAMPLE 1

It is intended to apply the method according to the invention to the preparation of a steel corresponding to AISI 1045 standard and containing in % mass:

C: 0.42 to 0.48
Si: 0.15 to 0.30
Mn: 0.60 to 0.90
S: 0.018 to 0.025

1. Preparation of the steel by the usual methods in an 80 ton arc furnace from scrap iron, with oxidizing melting, blowing of oxygen, dephosphorization, cleaning and recarbonation.

2. Casting of metal in magnesia ladle, part of the manganese may be added to the ladle in the form of ferro-manganese. Deoxidation by addition of aluminum in the casting jet (1.5 kg/ton=120 kg). Placing a lime bed on the metal (8 kg/ton of anhydrous lime powder, =640 kg). From the start of the casting, mixing of the metal by blowing in argon. Sampling of the steel 1 minute after the end of the casting. The makeup of the steel then is in % in mass:

C=0.40;
Si=0.12;
Mn=0.61;
in ppm:
Al=520;
S=100.

3. Mixing of the metal by argon during 20 minutes. Adjustment of the composition by addition of pig iron and ferro manganese. The following composition in % in mass then is obtained:

C=0.44;
Si=0.11;
Mn=0.72
in ppm:
Al=250;
S=40;
$O_2$=25

4. Introduction into the metal of a cored wire containing 180 gram per meter of silico calcium at 31% in mass of calcium. This wire is introduced at the speed of 120 meters/minute, that is 6.7 kg per minute of calcium during 3 minutes, that is an addition of 0.25 kg of calcium per ton of liquid steel. A slight mixing of the liquid steel by argon is maintained during 3 minutes after the end of the injection. A sample taken after these 3 minutes has the following composition:

in % in mass:
C=0.45;
Si=18
Mn=0.73
in ppm:
Al=230;
$O_2$=20;
S=30;
Ca=40

5. Resulfurization by injecting into the steel, after 3 minutes of slight mixing following the addition of calcium, a cored wire containing 135 grams per meter of flowers of sulfur. The injection speed is 90 meters/minute and the introduction of the sulfur lasts 1 minute and 20 seconds; that is a total addition of sulfur of 16.2 kgs. of sulfur or 200 ppm.

6. The metal is cast into round bars of 223 mm in diameter by continuous rotary casting, by passing first into a container provided with a basic coating. The final composition of the cast product is as follows:

in % in mass:
C=0.45;
Si=0.17;
Mn=0.72
in ppm:
Al=220;
$O_2$=30;
S=220;
Ca=36

7. These round bars are laminated into mechanical tubes of 180 mm outside diameter and 20 mm thickness. The tubes obtained in this manner offer a machinability by means of carbide cutting tools which is far superior to that of the standard steels of the same composition.

EXAMPLE 2

The same steel as in Example 1 is prepared under similar conditions, but the additions of calcium and sulfur finally are carried out with the aid of a cored wire containing a mixture of flowers of sulfur and silico-calcium at 30% in mass of calcium.

This mixture contains 20% sulfur and 80% silico-carcium. This cored wire weighs 170 grams per meter. It is introduced at the rate of 120 meters per minute during 4 minutes and 7 seconds and the results obtained are similar to those of Example 1.

What is claimed is:

1. A method for the preparation of a steel with high machinability wherein a non-alloyed, alloyed of stainless steel is worked up by melting, the method comprising adding aluminum to said steel to reduce the oxygen content of the steel to less than 100 ppm, desulfurizing said steel by utilizing a basic slag to reduce the sulfur content of the steel to less than 100 ppm, and adding calcium and sulfur by means of at least one cored wire to attain a content of calcium of 20 to 100 ppm and a sulfur content of 150 to 500 ppm in the steel.

2. The method as defined in claim 1 wherein aluminum is added such that the residual content of dissolved aluminum in the steel will range between 150 and 500 ppm.

3. The method as defined in claim 1 or 2, wherein the deoxidation is carried out to reduce the oxygen content of the steel to less than 50 ppm.

4. The method as defined in claim 1 or 2 wherein the sulfur content of the steel is reduced to less than 50 ppm.

5. The method as defined in claim 1 wherein the additions of calcium and sulfur are carried out successively, with the addition of the calcium being made first.

6. The method as defined in claim 5, wherein the addition of calcium is carried out by means of a cored wire containing a calcium alloy in granular form.

7. The method as defined in claim 5 or 6, wherein the addition of sulfur is carried out by means of a cored wire containing flowers of sulfur or a sulfide.

8. The method as defined in claim 1, wherein the addition of calcium and sulfur is carried out simultaneously with the aid of at least one cored wire.

9. The method as defined in any claim 1 wherein the addition of sulfur ranges between 150 and 300 ppm.

10. The method as defined claim 1 or 9, wherein the addition of sulfur is conducted such that the sulfur content of the steel is adjusted with such an accuracy that the spread between the sulfur content obtained and the content intended does not exceed ±40 ppm.

11. The method as defined in claim 1 wherein the reduction phases of the oxygen content, the desulfurization, the addition of calcium and of sulfur are carried out in the ladle.

12. The method as defined in claim 1 wherein the steel is cast by continuous casting.

* * * * *

UNITED STATES PATENT OFFICE

CERTIFICATE OF CORRECTION

Patent No. 4,531,972 Dated July 30, 1985

Inventor(s) Andre Gueussier, et al.

It is certified that error appears in the above-identified patent and that said Letters Patent are hereby corrected as shown below:

Column 5, line 6, change "of" to --or--

Signed and Sealed this

*Twenty-fifth* Day of *March 1986*

[SEAL]

*Attest:*

DONALD J. QUIGG

*Attesting Officer*

*Commissioner of Patents and Trademarks*